United States Patent [19]

Hu

[11] Patent Number: 4,741,363

[45] Date of Patent: May 3, 1988

[54] FLUID FAUCET

[75] Inventor: Lee-Ping Hu, Hsin Tien, Taiwan

[73] Assignee: Hydrotek Corporation, Taichung, Taiwan

[21] Appl. No.: 925,498

[22] Filed: Oct. 29, 1986

[51] Int. Cl.[4] ..... F16K 11/06; F16K 31/06

[52] U.S. Cl. ..... 137/607; 4/623; 137/613; 251/129.04

[58] Field of Search ..... 137/607, 613, 625.41, 137/614; 251/129.04; 4/304, 305, 623, DIG. 3

[56] References Cited

U.S. PATENT DOCUMENTS

| | | | |
|---|---|---|---|
| 2,706,492 | 4/1955 | Horland | 137/607 |
| 2,935,079 | 5/1960 | Shelton | 137/625.41 X |
| 3,328,592 | 6/1967 | Shaw . | |
| 3,415,278 | 12/1968 | Yamamoto et al. . | |
| 3,460,571 | 8/1969 | Moen . | |
| 3,556,146 | 1/1971 | Groen . | |
| 3,576,277 | 4/1971 | Blackmon . | |
| 3,584,636 | 6/1971 | Pettis, Jr. . | |
| 3,585,653 | 6/1971 | Forbes et al. | 4/623 |
| 3,638,680 | 2/1972 | Kopp | 137/607 |
| 3,698,438 | 10/1972 | Rozmus . | |
| 3,724,913 | 4/1973 | Levy . | |
| 3,799,198 | 3/1974 | Kijimoto . | |
| 3,901,261 | 8/1975 | Riis . | |
| 4,141,383 | 2/1979 | Geimer . | |
| 4,207,466 | 6/1980 | Drage et al. . | |
| 4,222,410 | 9/1980 | Geimer . | |
| 4,298,280 | 11/1981 | Harney . | |
| 4,305,021 | 12/1981 | Schreiden . | |
| 4,309,781 | 1/1982 | Lissau | 4/305 X |
| 4,402,095 | 9/1983 | Pepper | 4/305 X |

FOREIGN PATENT DOCUMENTS

| | | | |
|---|---|---|---|
| 1658176 | 9/1970 | Fed. Rep. of Germany | 137/607 |

*Primary Examiner*—Martin P. Schwadron
*Assistant Examiner*—Stephen M. Hepperle
*Attorney, Agent, or Firm*—Merchant, Gould, Smith, Edell, Welter & Schmidt

[57] ABSTRACT

A fluid faucet includes a first passage having a first mouth and connected to a first fluid source, a second passage having a second mouth and connected to a second fluid source, a hollow cylinder having a first hole and a second hole, a third passage having a third mouth for passing a fluid mixed from the first and second fluids, an electromagnetic valve having a valve stem engagable with the third mouth and an infrared coupling-and-controlling circuit. The first and second holes are capable of respectively fully shielding or communicating with the first and second mouths when the hollow cylinder is rotated. The infrared coupling-and-controlling circuit actuates the electromagnetic valve to set the valve stem to be in disengagement with the third mouth to permit the mixed fluid passing through the third mouth when a body is in a distance close enough to such a faucet.

2 Claims, 4 Drawing Sheets

FLUID FAUCET

This is a continuation, of application Ser. No. 784,709 now abandoned, filed Oct. 4, 1986, which is a continuation of Ser. No. 574,670, filed on Jan. 7, 1984, which is now abandoned.

BACKGROUND OF THE INVENTION

The present invention relates to a fluid faucet, and more particularly to a faucet incorporating a controlling means to discharge a fluid when a body is sensed to be close enough to the faucet.

The known fluid faucets, e.g. water faucets are closed and opened by rotating their handwheels. It is our experience that the handwheels are prone to contaminations of various kinds. Moreover, it will make the situation worse for the handwheels of a public building. Besides, for the output of a uniform mixed fluid one must separately set the opening amounts of two faucets on two fluid suppliers. To the applicant's knowledge, at present, there is not a faucet which can accommodate the discharging quantities of two fluid only by an adjusting medium or bears no handwheel.

SUMMARY OF THE INVENTION

It is therefore an object of the present invention to provide a fluid faucet capable of working without a handwheel to be rotated.

It is therefore another object of the present invention to provide a fluid faucet which can accommodate the discharging quantities of two kinds of fluids only by an adjusting medium.

It is yet another object of the present invention to provide a fluid faucet capable of saving the fluid from avoidable consumption.

According to the present invention, a fluid faucet includes a first passage having a first mouth and adapted to be connected to a first fluid source and a controlling means capable of disengaging with the first mouth when a body is close enough to the faucet to allow a first fluid from the first fluid source passing through the first mouth and engaging with the first mouth when the body is remote enough from the faucet to prevent the first mouth from passing the first fluid.

The faucet can further include a second passage having a second mouth and adapted to be connected to a second fluid source and the second mouth is to be in communication with the first mouth such that the controlling means is capable of disengaging and engaging with the first and second mouths at the same time.

Preferably the faucet further includes a guarding means acting as an adjusting medium for adjusting the opening amount of each of the first and second mouths.

Typically, the guarding means is a hollow cylinder and includes a first hole capable of fully escaping from the first mouth when the cylinder is in a first position and fully communicating with the first mouth when the cylinder is in a second position and a second hole capable of fully escaping from the second mouth when the cylinder is in the second position and fully communicating with the second mouth when the cylinder is in the first position so that the cylinder can guard the opening amounts of both of the first and second mouths when the cylinder is in a position between the first and second positions to accommodate the passing quantities, passed through the first and second mouths, of the first fluid and a second fluid from the second fluid source.

In one embodiment, the cylinder is designed such that the change of the positions is achieved by rotating the cylinder without resulting the cylinder in axial translation.

Preferably the faucet further includes a third passage having a third mouth for passing the mixed fluid constituted from the first and second fluids and an outlet for discharging the mixed fluid.

Typically, the controlling means can include an electromagnetic valve having a valve stem engagable with the third mouth and an infraraed coupling-and-controlling circuit for sensing a body to actuate the electromagnetic valve in order to set the valve stem to be in disengagement with the third mouth when the body is in a distance close enough to the faucet and de-actuating the electromagnetic valve to leave the valve stem to be in engagement with the third mouth to prevent the mixed fluid from passing through the third mouth when the body is in a distance remote enough from the faucet.

Typically, the infrared coupling-and-controlling circuit is to be powered by a regulated voltage and can include a signal generator for generating infrared rays of intermediate frequency, a receiver for receiving the infrared rays reflected from a body to effect a potential difference and for giving a voltage output obtained through amplifying the potential difference, a filter filtering the voltage output and transmitting an output signal of stabilized voltage, an amplifier amplifying the output signal and an electronic trigger receiving the amplified output signal and triggering the electromagnetic valve when the reflected infrared rays received by the receiver reach a certain quantity.

The present invention may best be understood with reference to the accompanying drawings.

DETAILED DESCRIPTION OF THE PREFERRED EMBODIMENT

Figure 1:
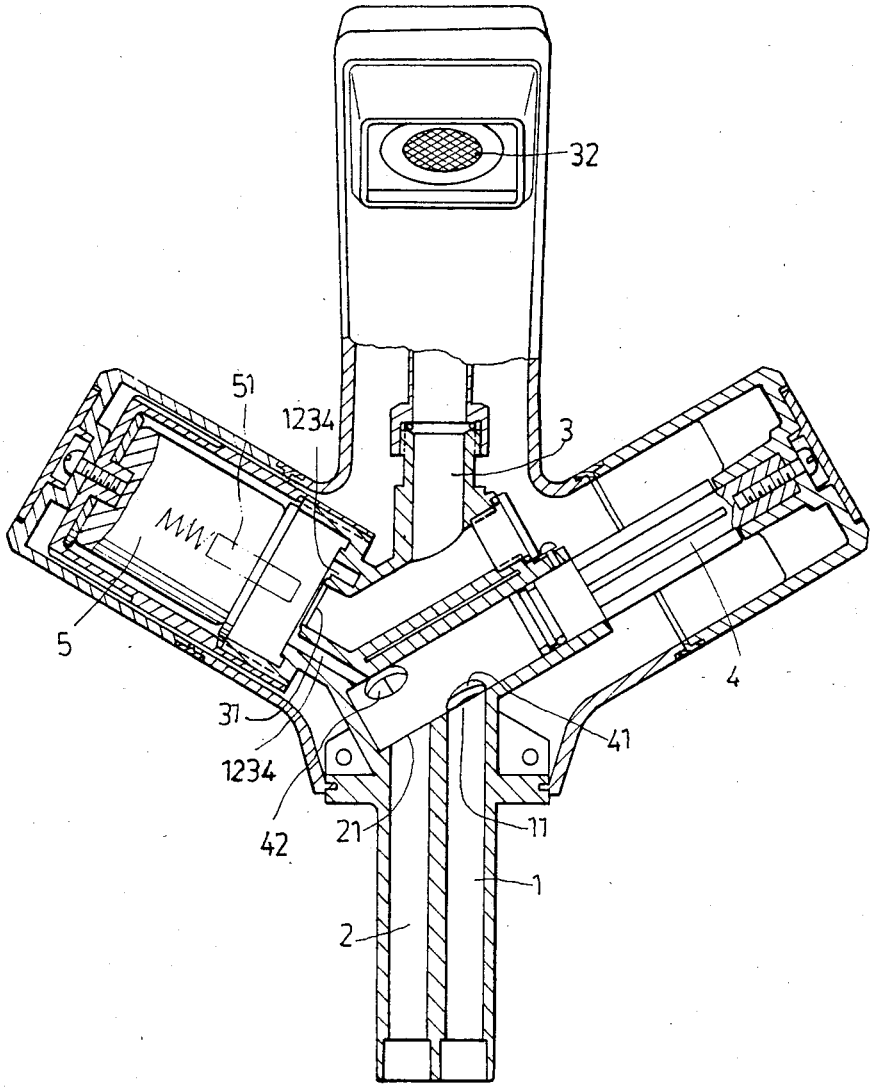
FIG. 1 is a partial sectional view showing a preferred embodiment of a fluid faucet of the present invention.
Figure 2:
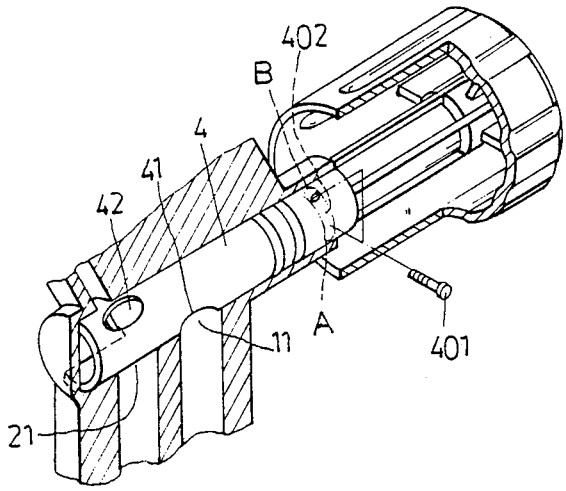
FIG. 2 is a fragmentary sectional view showing a guarding means in engagement with two fluid passages of a fluid faucet of the present invention.
Figure 3:
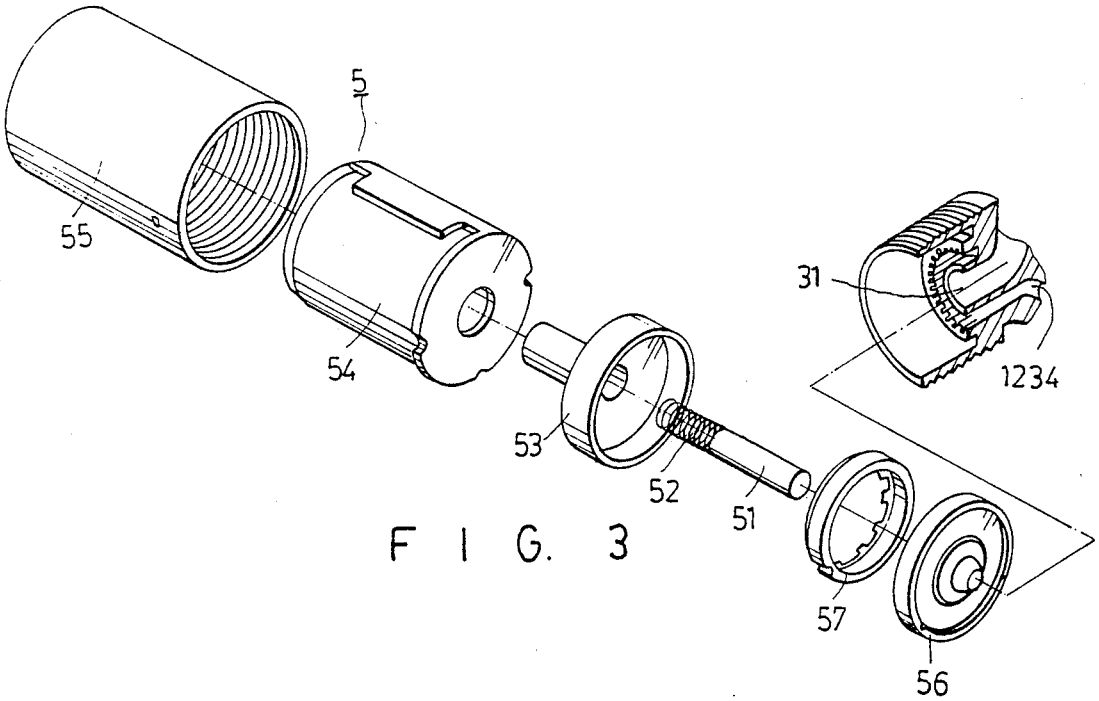
FIG. 3 is an exploded and sectional view showing how an electromagnetic valve engages with a third mouth of a third passage of a fluid faucet of the present invention.

Referring now to FIG. 1, there is shown a sectional view of the main part of a preferred embodiment of a fluid faucet of the present invention, which includes a frist passage 1 having a first mouth 11, a second passage 2 having a second mouth 21, a third passage 3 having a third mouth 31 and an outlet 32, a guarding means 4 having a first hole 41 and a second hole 42, an electromagnetic valve 5 having a valve stem 51 engagable with third mouth 31 and an infrared coupling-and-controlling circuit (not shown in FIG. 1). As shown in FIG. 2, guarding means 4 is designed to be a hollow cylinder axially secured by a screw 401 and confined by a groove 402 to be rotatable between two positions A and B. First hole 41 is capable of fully escaping from first mouth 11 when hollow cylinder 4 lets screw 401 contact with position A and fully communicating with first mouth 11 when screw 401 contacts position B of groove 402. Second hold 42 is capable of fully escaping from second mouth 21 when cylinder 4 lets screw 401 contact with position B and fully communicating with second mouth 21 when screw 401 contacts position A of groove 402. Thus, cylinder 4 will guard or regulate the opening amounts of both of first mouth 11 and second mouth 21 when cylinder 4 lets screw 401 be in a position between the two positions A and B. First passage 1 can pass a first fluid and second passage 2 can pass a second fluid different from the first fluid in some way, e.g. the first fulid is cold water and the second fluid is hot water. The fluid, mixed through cylinder 4, goes through a communicating passage 1234 and third mouth 31 to third passage 3 for being discharged out of outlet 32. As shown in FIG. 3, electromagnetic valve 5 includes a valve body 54, a valve stem receiver 53, a spring 52, a valve stem 51, a mouth engaging disc 56, an intermediate ring 57 and a valve cover 55. Spring 52 urges valve stem 51 to set mouth engaging disc 56 to be sealingly engaged with third mouth 31 when electromagnetic valve 5 is not actuated. Spring 52 is compressed by valve stem 51 when electromagnetic valve 5 is actuated by the infrared coupling-and-controlling circuit (wil be described later), and thus, the fluid contained within communicating passage 1234 pushes mouth engaging disc 56 to axially go in the direction which spring 52 is compressed and passes through third mouth 31 to third passage 3 for being discharged from outlet 32.

Figure 6:
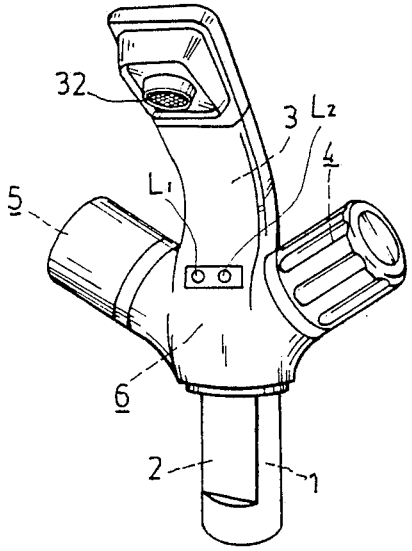
FIG. 6 is a perspective view showing the outer appearance of a fluid faucet of the present invention.

As shown in FIG. 6, a fluid faucet of the present invention can be enclosed by a smooth housing. Electromagnetic valve 5 is actuated by an infrared coupling-and-controlling circuit 6 which actuates elctromagnetic valve 5 to set mouth engaging disc 56 disengaging from third mouth 31 when a body is sensed to be in a distance close enough to such a faucet and de-actuates electromagnetic valve 5 to leave disc 56 engaging with third mouth 31 to prevent the mixed fluid from passing through third mouth 31 when the body is in a distance remote enough from the present faucet.

Figure 4:
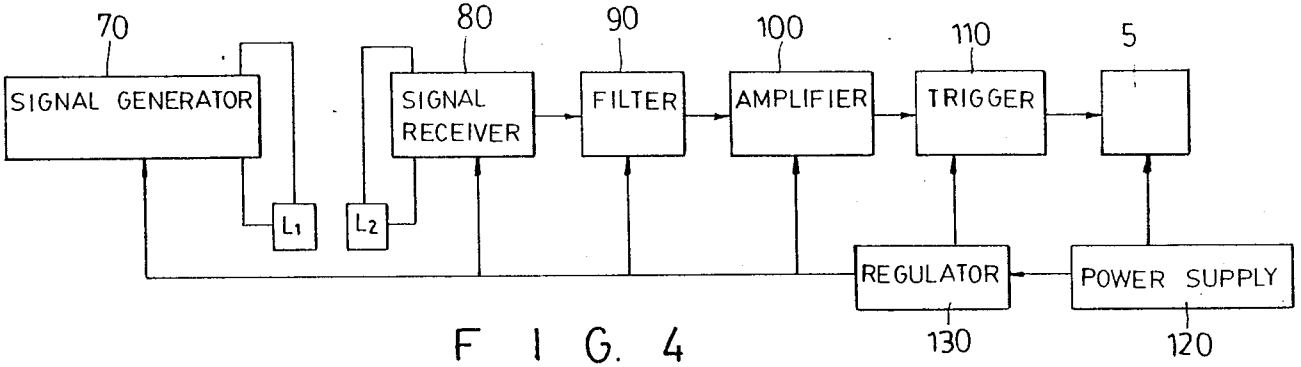
FIG. 4 is a block diagram representing an infrared coupling-and-controlling circuit of a fluid faucet of the present invention.

A typical block diagram of an infrared couplingand-controlling circuit 6 of a fluid faucet of the present invention is shown in FIG. 4. Infrared couplingand-controlling circuit 6 includes a signal generator 70 for generating infrared rays of intermediate frequency, a receiver 80 for receiving the infrared rays reflected from a body to effect a potential difference and for giving a voltage output obtained through amplifying the potential difference, a filter 90 filtering the voltage output and transmitting an output signal of stabilized voltage, an amplifier 100 amplifying the output signal of filter 90 and an electronic trigger 110 receiving the amplified output signal and triggering electromagnetic valve 5 when the reflected infrared rays received by receiver 80 reach a certain quantity and such a circuit 6 is powered by a power supply 120 regulated by a regulator 130.

Figure 5:
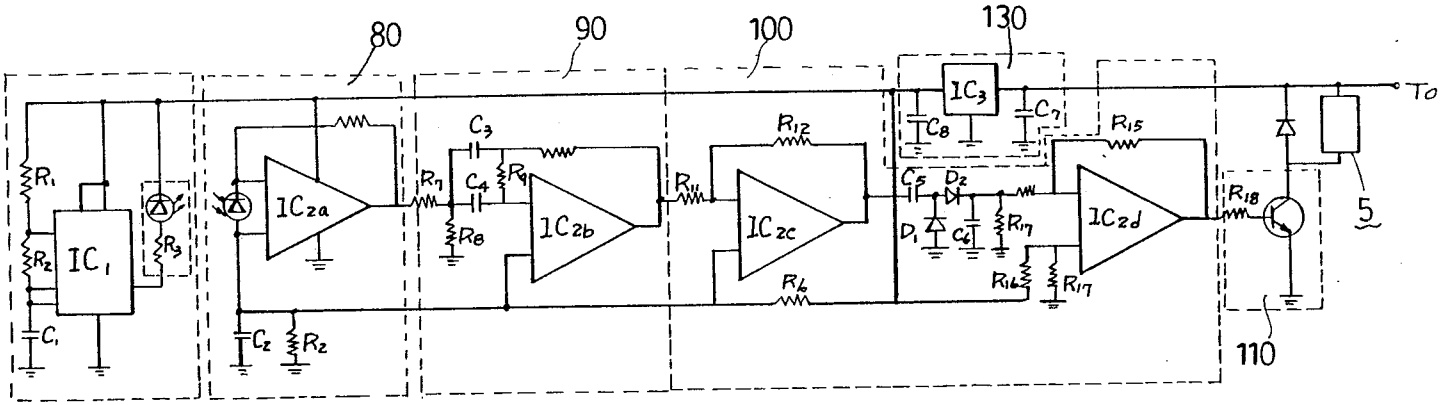
FIG. 5 is a circuit diagram of an infrared coupling-and-controlling circuit of a fluid faucet of the present invention.

A typical circuit diagram of an infrared coupling-and-controlling circuit is shown in FIG. 5 which can be read above suspicion by one skilled in the art and therefore will be not described in any more detail.

While the present invention has been described in connection with what is presently considered to be the most practical and preferred embodiment, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What I claim is:

1. A water faucet comprising:

a first passage having a first mouth and adapted to be connected to a hot water source;

a second passage having a second mouth and adapted to be connected to a cold water source wherein said second mouth is in communication with said first mouth;

a third passage having a third mouth for passing the mixed water constituted from said hot and cold water;

an outlet for discharging said mixed water;

a hollow tube passing through said first and second passages for guarding the opening amount of each of said first and second mouths, said tube including a first hole capable of fully escaping from said first mouth when said tube is in a first position and fully communicating with said first mouth when said tube is in the second position, and a second hole capable of fully escaping from said second mouth when said tube is in a second position and fully communicating with said second mouth when said tube is in said first position and a third hole permitting the mixed water to enter a communicating passage between said tube and said third passage, whereby said tube will guard the opening amounts of both of said first and second mouths when said tube is in a position between said first and said second position to regulate water passed through said first and second mouths from said hot and said cold water sources;

a handle connected to said tube for moving said tube between said first position and said second position without resulting in axial translation of said tube;

a mouth engaging disk capable of sealingly engaging said third mouth;

an electromagnetic valve including:

a valve stem for engaging said mouth engaging disk which in turn sealingly engages said third mouth;

a spring connected to the end of said valve stem that does not engage said mouth engaging disk;

a valve stem receiver for receiving said valve stem and said spring when said electromagnetic valve is actuated; and a valve body for housing said valve stem receiver, whereby said spring biases said valve stem against said mouth engaging disk and prevents the water from entering said third mouth when said electromagnetic valve is not actuated and whereby said spring is compressed by said valve stem into said valve stem receiver when said electromagnetic valve is actuated allowing the water contained within said communicating passage to push said mouth engaging disk axially to compress said spring and allow said water to pass through said third mouth to said third passage and to be discharged from said outlet;

a sensing means with an infrared coupling-and-controlling circuit for sensing a body, said circuit actuating said electromagnetic valve to permit said mixed water to pass through said third mouth when said body is at a distance close to said faucet and to deactuate said electromagnetic valve to prevent said mixed water from passing through said third mouth when said body is at a distance remote from said faucet, said circuit adapted to be powered by a regulator voltage, said circuit including:

a signal generator for generating infrared rays of intermediate frequency;

a receiver for receiving said infrared rays reflected from said body to effect a potential difference and for giving a voltage output obtained through amplifying said potential difference;

a filter for filtering said voltage output and transmitting an output signal of stabilized voltage;

an amplifier amplifying said output signal; and an electronic trigger for receiving the amplified output signal and triggering said electromagnetic valve when said reflected rays received by said receiver reach a certain quantity.

2. In a water faucet of the type having a first passage having a first mouth and adapted to be connected to a hot water source; a second passage having a second mouth and adapted to be connected to a cold water source wherein said second mouth is in communication with said first mouth; a third passage having a third mouth for passing the mixed water constituted from said hot and cold water; an outlet for discharging said mixed water; a hollow tube passing through said first and second passages for guarding the opening amount of each of said first and second mouths, said tube including a first hole capable of fully escaping from said first mouth when said tube is in a first position and fully communicating with said first mouth when said tube is in the second position, and a second hole capable of fully escaping from said second mouth when said tube is in a second position and fully communicating with said second mouth when said tube is in said first position, and a third hole permitting the mixed water to enter a communicating passage between said tube and said third passage, whereby said tube will guard the opening amounts of both of said first and second mouths when said tube is in a position between said first and said second position to regulate water passed through said first and second mouths from said hot and said cold water sources; a handle connected to said tube for moving said tube between said first position and said second position without resulting in axial translation of said tube; the improvement comprising:

a mouth engaging disk capable of sealingly engaging said third mouth;

an electromagnetic valve including:

valve stem for engaging said mouth engaging disk which in turn sealingly engages said third mouth;

a spring connected to the end of said valve stem that does not engage said mouth engaging disk;

a valve stem receiver for receiving said valve stem and said spring when said electromagnetic valve is actuated; and a valve body for housing said valve stem receiver, whereby said spring biases said valve stem against said mouth engaging disk and prevents the water from entering said third mouth when said electromagnetic valve is not actuated and whereby said spring is compressed by said valve stem into said valve stem receiver when said electromagnetic valve is actuated allowing the water contained within said communicating passage to push said mouth engaging disk axially to compress said spring and allow said water to pass through said third mouth to said third passage and to be discharged from said outlet;

a sensing means with an infrared coupling-and-controlling circuit for sensing a body, said circuit actuating said electromagnetic valve to permit said mixed water to pass through said third mouth when said body is at a distance close to said faucet and to deactuate said electromagnetic valve to prevent said mixed water from passing through said third mouth when said body is at a distance remote from said faucet, said circuit adapted to be powered by a regulated voltage, said circuit including:

a signal generator for generating infrared rays of intermediate frequency;

a receiver for receiving said infrared rays reflected from said body to effect a potential difference and for giving a voltage output obtained through amplifying said potential difference;

a filter for filtering said voltage output and transmitting an output signal of stabilized voltage; and an electronic trigger for receiving the output signal and triggering said electromagnetic valve when said reflected rays received by said receiver reach a certain quantity.

* * * * *

UNITED STATES PATENT AND TRADEMARK OFFICE

CERTIFICATE OF CORRECTION

PATENT NO. : 4,741,363

DATED : May 3, 1988

INVENTOR(S) : Lee-Ping Hu

It is certified that error appears in the above-identified patent and that said Letters Patent is hereby corrected as shown below:

Column 3, line 17, "fulid" should be --fluid--;

Column 3, line 46, "couplingand-controlling" should be --coupling-and-controlling--;

Column 3, line 48, "couplingand-controlling" should be --coupling-and-controlling--.

Signed and Sealed this

Eighth Day of November, 1988

*Attest:*

*Attesting Officer*

DONALD J. QUIGG

*Commissioner of Patents and Trademarks*